US010640432B2

(12) United States Patent
Schlueter

(10) Patent No.: US 10,640,432 B2
(45) Date of Patent: May 5, 2020

(54) IGNITION SYSTEM

(71) Applicant: Aerojet Rocketdyne, Inc., Sacramento, CA (US)

(72) Inventor: Samuel Schlueter, Folsom, CA (US)

(73) Assignee: Aerojet Rocketdyne, Inc., Rancho Cordova, CA (US)

( * ) Notice: Subject to any disclaimer, the term of this patent is extended or adjusted under 35 U.S.C. 154(b) by 0 days.

(21) Appl. No.: 15/569,474

(22) PCT Filed: Mar. 11, 2016

(86) PCT No.: PCT/US2016/021985
§ 371 (c)(1),
(2) Date: Oct. 26, 2017

(87) PCT Pub. No.: WO2016/178744
PCT Pub. Date: Nov. 10, 2016

(65) Prior Publication Data

US 2018/0086676 A1 Mar. 29, 2018

Related U.S. Application Data

(60) Provisional application No. 62/156,247, filed on May 2, 2015.

(51) Int. Cl.

| | |
|---|---|
| ***C06B 43/00*** | (2006.01) |
| ***C06B 27/00*** | (2006.01) |
| ***C06C 9/00*** | (2006.01) |
| *F42C 19/08* | (2006.01) |

(52) U.S. Cl.
CPC ..... *C06B 43/00* (2013.01); *C06B 27/00* (2013.01); *C06C 9/00* (2013.01); *F42C 19/0819* (2013.01)

(58) Field of Classification Search
CPC ..... F42B 3/12; C06B 43/00; C06B 27/00
See application file for complete search history.

(56) References Cited

U.S. PATENT DOCUMENTS

| | | | | |
|---|---|---|---|---|
| 3,729,935 A | | 5/1973 | Fletcher et al. | |
| 3,734,019 A | | 5/1973 | Rentz et al. | |
| 3,776,958 A | * | 12/1973 | Hill et al. | C06B 25/04 102/202.7 |
| 4,152,988 A | * | 5/1979 | Haas | F42B 3/198 102/202.11 |
| 4,208,967 A | | 6/1980 | Betts | |
| 5,042,386 A | | 8/1991 | Kruse et al. | |
| 6,087,591 A | * | 7/2000 | Nguyen | C08L 67/02 174/110 R |

(Continued)

OTHER PUBLICATIONS

Anonymous. Sigmund Cohn—Pyrofuze. Retrieved May 27, 2016 from: https:/iweb.archive.orglwebl20150224220550/http:/isigmundcohn.com/internal.asp?pagel D=11.

(Continued)

*Primary Examiner* — Joshua E Freeman

(57) ABSTRACT

An ignition system includes a multi-metallic ignition body that has at least two metallic elements in contact with each other. The metallic elements define an ignition initiation temperature above which there is a self-sustaining alloying reaction. A fluorine-containing body is in contact with the multi-metallic ignition body. The metallic elements may include palladium or palladium-ruthenium and aluminum.

7 Claims, 2 Drawing Sheets

FIG.3

(56) References Cited

U.S. PATENT DOCUMENTS

| | | | | |
|---|---|---|---|---|
| 6,359,230 | B1 * | 3/2002 | Hildreth | H01B 3/441 174/110 R |
| 2008/0241534 | A1 * | 10/2008 | Ohtani | C08F 214/18 428/375 |
| 2012/0055594 | A1 | 3/2012 | Kellett et al. | |
| 2014/0209347 | A1 * | 7/2014 | Buck | H01B 7/041 174/106 R |

OTHER PUBLICATIONS

International Search Report for International Patent Application No. PCT/2016/021985 completed May 27, 2016.
International Preliminary Report on Patentability for PCT/US2016/021985 dated Nov. 16, 2017.

* cited by examiner

IGNITION SYSTEM

REFERENCE TO RELATED APPLICATIONS

This application claims priority to U.S. Provisional Application No. 62/156,247, filed on May 2, 2015.

BACKGROUND

Pyrotechnic ignition materials are used for ignition in rocket motors. One example ignition material is boron potassium nitrate. Boron potassium nitrate has attractive handling characteristics; however, as an ignition material it has relatively low energy and ignition rate. While there are ignition materials that have higher energy and ignition rates, such materials fall short of the desired handling characteristics and thus cannot be used in substitute of boron potassium nitrate.

SUMMARY

An ignition system according to an example of the present disclosure includes a wire having an outer jacket encasing an inner core. The outer jacket includes palladium and ruthenium, and the inner core includes aluminum, and a fluorine-containing polymer coating on the wire.

In a further embodiment of any of the foregoing embodiments, the fluorine-containing polymer coating includes a fluorocarbon polymer with carbon-fluorine bonds.

In a further embodiment of any of the foregoing embodiments, the fluorine-containing polymer coating is selected from a group consisting of polytetrafluoroethylene (PTFE), fluorinated ethylene propylene (FEP), polyvinylidene fluoride (PVF), hexafluoropropylene (HFP), polyvinylfluoride (PVD), polyethylenetetrafluoroethylene (ETFE), and combinations thereof.

In a further embodiment of any of the foregoing embodiments, the outer jacket has, by weight, approximately 95% of palladium and approximately 5% of ruthenium.

In a further embodiment of any of the foregoing embodiments, the inner core has, by weight, approximately 95% of aluminum.

An ignition system according to an example of the present disclosure includes a multi-metallic ignition body including at least two metallic elements in contact with each other. The at least two metallic elements define an ignition initiation temperature above which there is a self-sustaining alloying reaction of the at least two metallic elements. A fluorine-containing body is in contact with the multi-metallic ignition body.

In a further embodiment of any of the foregoing embodiments, the at least two metallic elements include aluminum and palladium.

In a further embodiment of any of the foregoing embodiments, the at least two metallic elements further include ruthenium.

In a further embodiment of any of the foregoing embodiments, the at least two metallic elements includes a first metallic element and a second metallic element in one or more filaments, and each of the one or more filaments includes an outer jacket of the first metallic element that circumscribes an inner core of the second metallic element.

In a further embodiment of any of the foregoing embodiments, the multi-metallic ignition body includes a plurality of the filaments.

A method of fabricating an ignition system according to an example of the present disclosure includes providing a multi-metallic ignition body that includes at least two metallic elements in contact with each other and bringing a fluorine-containing body into contact with the multi-metallic ignition body. The at least two metallic elements define an ignition initiation temperature above which there is a self-sustaining alloying reaction of the at least two metallic elements.

In a further embodiment of any of the foregoing embodiments, the fluorine-containing body is a tube, and the bringing of the fluorine-containing body into contact with the multi-metallic ignition body includes shrink-wrapping the tube onto the multi-metallic ignition body.

In a further embodiment of any of the foregoing embodiments, the fluorine-containing body is initially a liquid, and the bringing of the fluorine-containing body into contact with the multi-metallic ignition body includes depositing the liquid onto the multi-metallic ignition body followed by solidifying the liquid to form the fluorine-containing body.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
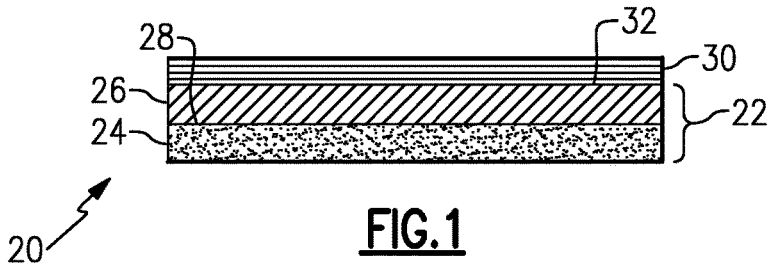
FIG. 1 illustrates an example of an ignition system that has a multi-metallic ignition body and a fluorine-containing body.

FIG. 1 schematically illustrates a sectioned view of a representative portion of an ignition system 20. In this example, the ignition system 20 includes a multi-metallic ignition body 22 that has at least two metallic elements 24/26 in contact with each other. Although not limited, the metallic elements 24/26 are in contact at interface 28 in the example shown. The ignition system 20 further includes a fluorine-containing body 30 in contact with the multi-metallic ignition body 22. Although also not limited, the fluorine-containing body 30 is in contact with the multi-metallic ignition body 22 at interface 32 in the example shown.

In the illustrated example, the metallic elements 24/26 of the multi-metallic ignition body 22 and the fluorine-containing body 30 are each provided as layers. Such layers are generally of uniform thickness and can be flat or curved, for example. As will be appreciated given this disclosure, the metallic elements 24/26 of the multi-metallic ignition body 22 and/or the fluorine-containing body 30 may alternatively be provided in geometries other than layers.

The metallic elements 24/26, as well as additional metallic elements if present, are reactive with each other, in the absence of oxygen, above an ignition initiation temperature. When heated above the ignition temperature by electric current or other energy source the metallic elements react in an exothermic self-sustaining alloying reaction to generate heat. The self-sustaining alloying reaction proceeds until the alloying is complete. For instance, the alloying reaction is rapid and results in deflagration without the support of oxygen.

While the reaction between the metallic elements 24/26 alone releases heat, at least the fluorine in the fluorine-containing body 30 also reacts to augment thermal release beyond that of the metals alone. For example, the fluorine serves as an oxidant to react with the metallic elements, the reaction products of the metallic elements, or both in a pyrotechnic chemical reaction. The exothermic reactions between the metallic elements, the metallic elements with the fluorine, and/or the byproducts of the metallic elements and fluorine releases heat and generates hot gases. The hot gases may contain the metallic elements, metal fluorides, fluorine, and/or metal carbides of the metallic elements. The hot gases may be utilized to rapidly pressurize and ignite a grain material, such as a solid propellant grain material in a rocket motor.

In one example, the metallic elements 24/26 of the multi-metallic ignition body 22 are based upon at least palladium and aluminum. For example the metallic element 24 is aluminum or an aluminum-based alloy and the metallic element 26 is palladium or a palladium-based alloy. Although not limited, one example of a useful aluminum alloy is aluminum alloy 5056, which has, by weight, approximately 5% magnesium, approximately 0.12% manganese, approximately 0.12% chromium, and a remainder of aluminum and any impurities.

In a further example, the multi-metallic ignition body 22 includes ruthenium as an additional, reactive metallic element. The ruthenium may be provided as an alloy with the palladium. In one example the palladium-ruthenium alloy includes, by weight, approximately 95% palladium and approximately 5% ruthenium.

In additional examples, the fluorine-containing body 30 is a fluorine-containing polymer. One example of a fluorine-containing polymer is a fluorocarbon polymer. As used herein, a fluorocarbon polymer is a polymer that has carbon-fluorine bonds. Non-limiting examples of fluorine-containing polymers include polytetrafluoroethylene (PTFE), fluorinated ethylene propylene (FEP), polyvinylidene fluoride (PVF), hexafluoropropylene (HFP), polyvinylfluoride (PVD), polyethylenetetrafluoroethylene (ETFE), and combinations thereof.

Figure 2:
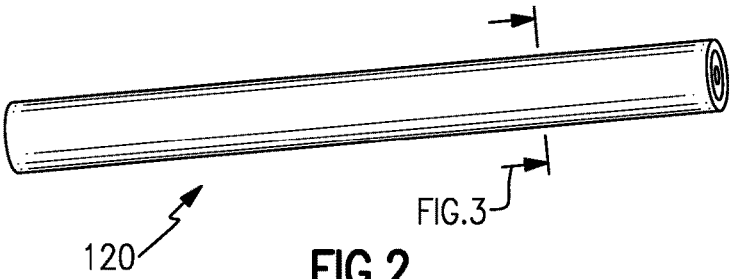
FIG. 2 is another example of an ignition system in the form of a wire or filament.
Figure 3:
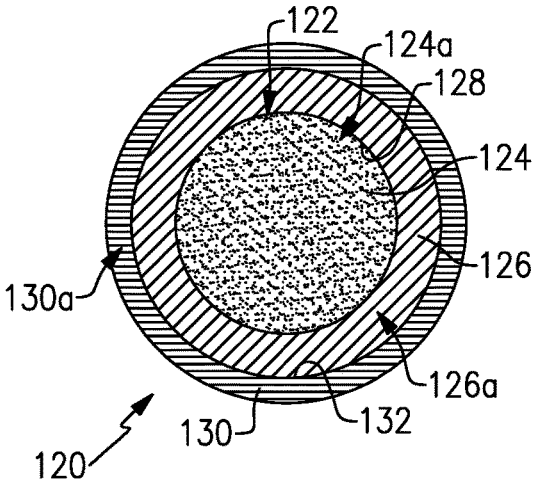
FIG. 3 is a sectioned view of the ignition system of FIG. 2.

FIG. 2 depicts another example of an ignition system 120, which is also shown in a sectioned view in FIG. 3. In this disclosure, like reference numerals designate like elements where appropriate and reference numerals with the addition of one-hundred or multiples thereof designate modified elements that are understood to incorporate the same features and benefits of the corresponding elements. The ignition system 120 is in the form of a wire or filament. The wire or filament includes a multi-metallic ignition body 122 that has two or more metallic elements 124/126 in contact with each other at interface 128. In this example, the metallic element 124 is provided as an inner core 124*a* and the metallic element 126 is provided as an outer jacket 126*a* that encases or circumscribes the inner core 124*a*. The outer jacket 126*a* may include palladium or palladium-ruthenium alloy as described above, and the inner core 124*a* may include aluminum or aluminum alloy as described above. One example of the metallic elements 124/126 is PYROFUZE® (Sigmund Cohn Corp.).

The ignition system 120 further includes a fluorine-containing body 130 in the form of a fluorine-containing polymer coating 130*a* that is in contact at interface 132 with the multi-metallic ignition body 122. The fluorine-containing polymer coating 130*a* may include the fluorine-containing polymer as described above.

By encasing the multi-metallic ignition body 122, the fluorine-containing polymer coating 130*a* protects the multi-metallic ignition body 122 from moisture infiltration, foreign substance exposure, mechanical damage, and the like. The ignition system 120 thus provides enhanced handling characteristics in combination with high energy release and good ignition rate from the reaction between the metals and also the fluorine oxidizer.

Figure 4:
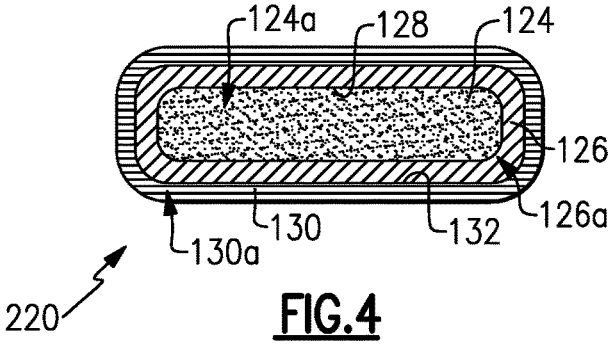
FIG. 4 is another example ignition system in the form of a ribbon.

In the example shown, the wire or filament is substantially circular in cross-section. FIG. 4 illustrates another example ignition system 220 that is similar to the ignition system 120 but has a modified geometry. Rather than circular, the filament is flattened in the form of a ribbon. Although not limited, the examples herein may also be adapted to other geometries, such as pellets that have the jacket-core configuration. Additionally, filaments, ribbons, pellets, or other geometries can be combined or used to form other architectures, such as but not limited to, rolled structures, intertwined structures, braided structures, divided/chopped structures, pressed rope structures, pressed block structures, and the like.

Figure 5:
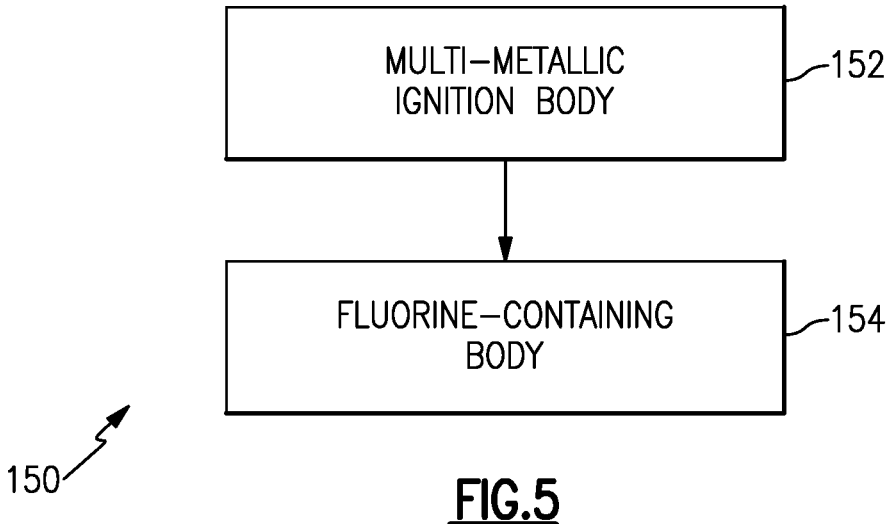
FIG. 5 is an example of a method of fabricating an ignition system.

FIG. 5 illustrates an example method 150 of fabricating the ignition systems 20/120/220 described herein. At 152 the method 150 includes providing the multi-metallic ignition body 22/122 described herein. At 154 the method 150 includes bringing the fluorine-containing body 30/130 into contact with the multi-metallic ignition body 22/122. Although not limited, the step 154 may involve a shrink-wrapping technique or a deposition technique. In the shrink-wrapping technique, the fluorine-containing body 30/130 is provided as a tube or sleeve. For instance, the tube or sleeve is formed of the fluorine-containing polymer that is pre-stressed. The tube or sleeve is initially larger in size than the multi-metallic ignition body 22/122. The tube or sleeve is arranged around the multi-metallic ignition body 22/122 and then heated. The heat relaxes the pre-stressed polymer, causing the polymer to shrink and conform around the multi-metallic ignition body 22/122.

The deposition technique may include initially providing the fluorine-containing polymer as a liquid. The liquid is deposited onto the multi-metallic ignition body 22/122 and then solidified to form the fluorine-containing body 30/130. The manner of deposition may be varied depending on the selected geometry of the ignition systems 20/120/220. Non-limiting examples may include dipping and spraying. The manner of solidification may depend on the type of polymer selected. As examples, the solidification may include curing the polymer or cooling the polymer.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. An ignition system comprising:

a pyrotechnic wire having an outer jacket encasing an inner core, the outer jacket including palladium and ruthenium, and the inner core including aluminum, the pyrotechnic wire igniting above an ignition temperature in an alloying reaction producing a thermal release; and an oxidizer augmenting the thermal release by exothermic reaction with at least one of the palladium, the ruthenium, the aluminum, or reaction products thereof, wherein the oxidizer is a fluorine-containing polymer coating in contact with an outer surface of the outer jacket and encasing the pyrotechnic wire and the coating also protects the wire from moisture infiltration.

2. The ignition system as recited in claim 1, wherein the fluorine-containing polymer coating includes a fluorocarbon polymer with carbon-fluorine bonds.

3. The ignition system as recited in claim 1, wherein the fluorine-containing polymer coating is selected from a group consisting of polytetrafluoroethylene (PTFE), fluorinated ethylene propylene (FEP), polyvinylidene fluoride (PVF), hexafluoropropylene (HFP), polyvinylfluoride (PVD), polyethylenetetrafluoroethylene (ETFE), and combinations thereof.

4. The ignition system as recited in claim 1, wherein the outer jacket has, by weight, approximately 95% of palladium and approximately 5% of ruthenium.

5. The ignition system as recited in claim 1, wherein the inner core has, by weight, approximately 95% of aluminum.

6. The ignition system as recited in claim 1, wherein the coating is of uniform thickness.

7. The ignition system as recited in claim 1, wherein the coating is an outermost layer and has an exposed outer surface.

* * * * *